US009422813B2

(12) United States Patent
Bonny

(10) Patent No.: US 9,422,813 B2
(45) Date of Patent: Aug. 23, 2016

(54) SYSTEM FOR MOTORIZED DISPLACEMENT OF A MOBILE ELEMENT, METHOD OF DRIVING SUCH A SYSTEM AND METHOD OF TESTING SUCH A SYSTEM

(75) Inventor: Franck Bonny, Paris (FR)

(73) Assignee: SAGEM DEFENSE SECURITE, Paris (FR)

( * ) Notice: Subject to any disclaimer, the term of this patent is extended or adjusted under 35 U.S.C. 154(b) by 405 days.

(21) Appl. No.: 13/876,134

(22) PCT Filed: Oct. 18, 2011

(86) PCT No.: PCT/EP2011/068190

§ 371 (c)(1),
(2), (4) Date: Mar. 26, 2013

(87) PCT Pub. No.: WO2012/052438

PCT Pub. Date: Apr. 26, 2012

(65) Prior Publication Data

US 2013/0192453 A1 Aug. 1, 2013

(30) Foreign Application Priority Data

Oct. 18, 2010 (FR) ..... 10 58486

(51) Int. Cl.
*B64C 13/50* (2006.01)
*F01B 25/00* (2006.01)

(52) U.S. Cl.
CPC ..... *F01B 25/00* (2013.01); *B64C 13/503* (2013.01)

(58) Field of Classification Search
CPC ..... F15B 18/00; F15B 9/17; B64C 13/42; B64C 13/503
See application file for complete search history.

(56) References Cited

U.S. PATENT DOCUMENTS

| | | | | |
|---|---|---|---|---|
| 4,905,933 | A * | 3/1990 | Ako | 244/99.4 |
| 8,033,509 | B2 * | 10/2011 | Yount et al. | 244/194 |
| 2004/0075020 | A1 * | 4/2004 | Trikha | 244/75 R |

FOREIGN PATENT DOCUMENTS

| | | | |
|---|---|---|---|
| EP | 0 864 491 | A1 | 9/1999 |
| FR | 2 908 107 | A1 | 5/2008 |
| WO | WO 2007/002311 | A1 | 1/2007 |
| WO | WO 2007002311 | A1 * | 1/2007 |

* cited by examiner

*Primary Examiner* — Nathaniel Wiehe
*Assistant Examiner* — Abiy Teka
(74) *Attorney, Agent, or Firm* — Muncy, Geissler, Olds & Lowe, P.C.

(57) ABSTRACT

The invention provides a motor-driven movement system for moving a movable element, the system comprising at least two actuators, each provided with means connecting it to the movable element and each dimensioned to be capable, on its own, of driving the movable element, a central control unit being connected to the two actuators in order to be capable of sending a position setpoint ($Pos_1$, $Pos_2$) to one or other of the actuators. According to the invention, the system further comprises control means for simultaneously controlling both actuators in terms of force in response to the position setpoint sent to one of the actuators. The invention also provides a method of driving such a system and a method of testing such a system.

8 Claims, 3 Drawing Sheets

SYSTEM FOR MOTORIZED DISPLACEMENT OF A MOBILE ELEMENT, METHOD OF DRIVING SUCH A SYSTEM AND METHOD OF TESTING SUCH A SYSTEM

The invention relates to a motor-driven movement system for moving a movable element, e.g. a motor-driven movement system for moving a movable flight control surface of an aircraft, such as a rudder. The invention also provides a method of driving such a system and a method of testing such a system.

TECHNOLOGICAL BACKGROUND OF THE INVENTION

An example of a motor-driven movement system for moving a movable element is a system comprising two actuators connected to the movable element and each dimensioned to be capable, on its own, of driving the movable element. The system also has a central control unit that is connected to the two actuators in order to send a position setpoint to each of the actuators. In operation, the central control unit sends a position setpoint to one of the actuators, referred to as a main actuator, which responds to the position setpoint by generating a force for moving the movable element. The second actuator, referred to as an emergency actuator, is not powered. In the event of the main actuator failing, the central control unit sends a position setpoint to the emergency actuator, which takes the place of the main actuator in order to move the movable element.

Nevertheless, since the lifetime of an actuator is directly linked to the forces it needs to develop, the main actuator wears quickly since, under normal operating conditions it is used on its own for driving the movable element. That is why provision may be made for each actuator to act in alternation as the main actuator and as the emergency actuator, but that complicates managing the operation of the actuators. It also remains necessary to dimension the actuators so as to be capable of developing the maximum force over very long periods, such that the actuators are relatively heavy and bulky.

Furthermore, under normal conditions of operation of the main actuator, the emergency actuator is inactive and thus generates a force on its connection to the movable element that tends to oppose the force developed by the main actuator for moving the movable element. The main actuator therefore needs to be dimensioned so as to be capable of overcoming this opposing force without consequence on the movement of the movable element.

Documents FR 2 908 107, US 2004/07500, ER 0 864 491, and WO 2007/002311 disclose motor-driven movement systems for moving movable elements, each system including two actuators, each of which is provided with means connecting it to the movable element. Each system includes a central control unit that, in a nominal situation, sends a control setpoint to one of the actuators such that said actuator acts alone to drive the movable element. In a situation that is more critical, e.g. in the event of turbulence opposing the movement of the movable element, the central control unit sends a control setpoint to each the actuators so that both actuators act simultaneously to drive the movable element. The use of only one or both actuators thus depends solely on the power needed to be able to drive the movable element.

OBJECT OF THE INVENTION

An object of the invention is to propose a motor-driven movement system for moving a movable element that obviates the above-mentioned problems, at least in part.

BRIEF DESCRIPTION OF THE INVENTION

In order to achieve this object, the invention provides a motor-driven movement system for moving a movable element, the system comprising at least two actuators, each provided with means connecting it to the movable element and each dimensioned to be capable, on its own, of driving the movable element, and a central control unit being connected to the two actuators in order to be capable of sending a position setpoint to one or other of the actuators.

According to the invention, the system further comprises control means for simultaneously controlling the two actuators in terms of force in response to the position setpoint sent to one of the actuators.

The control means serve to share the force that needs to be developed for moving the movable element between the two actuators so that neither of those actuators is stressed excessively more than the other. In addition, in the event of one of the actuators failing, the other actuator is capable, on its own, of moving the movable element.

Thus, the lifetimes of the actuators are substantially identical. Advantageously, the bulk and the weight of the actuators are found to be smaller than the bulk and the weight of actuators in a prior art motor-driven movement system using only one actuator since the fatigue dimensioning of actuators in the invention is less constraining.

Another advantage is that the actuators heat up less than in a prior art device.

Advantageously, the system of the invention enables the position setpoint coming from the central control unit to be shared between the two actuators without it being necessary to modify an operating algorithm of an already existing central control unit that is conventionally connected to two actuators for sending a position setpoint to only one of the actuators in normal circumstances. In the invention, the position setpoint is shared out as a first force setpoint and as a second. force setpoint downstream from where the position setpoint is generated for sending to one of the actuators.

The invention also provides a method of driving such a system and a method of testing such a system.

BRIEF DESCRIPTION OF THE DRAWINGS

The invention can be better understood in the light of the following description of a particular, non-limiting embodiment of the invention.

Reference is made to the accompanying drawings, in which.

DETAILED DESCRIPTION OF THE INVENTION

Figure 1:
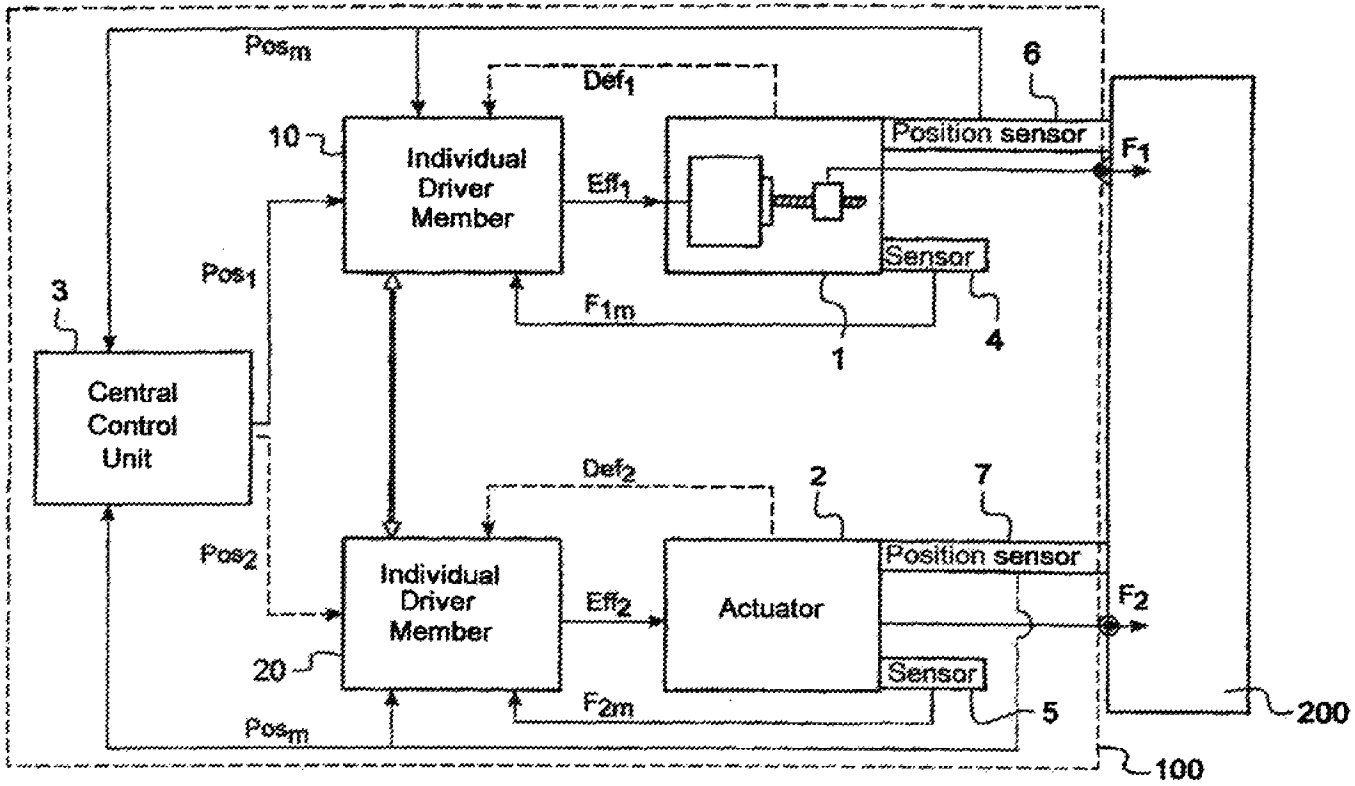
FIG. 1 is a diagrammatic view of a motor-driven system of the invention for moving a movable element.
Figure 2:
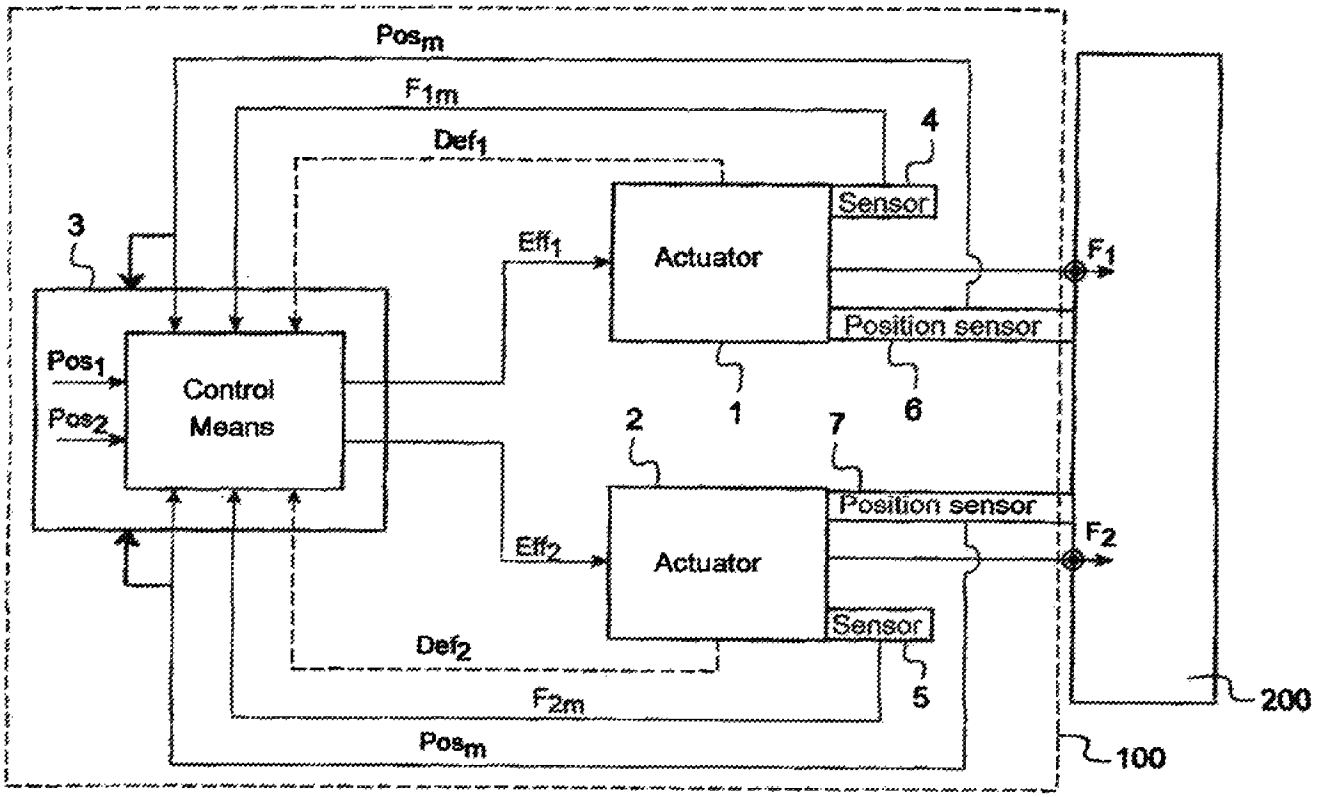
FIG. 2 is a diagrammatic view of a motor-driven system in a second embodiment of the invention for moving a movable element.

With reference to FIGS. 1 and 2, in this example concerning an aircraft, a motor-driven movement system 100 serves to transmit movement from a pilot control element, such as a stick, to a movable element 200, such as a rudder. The movement system comprises a first actuator 1 and a second actuator 2. In this example, each actuator 1, 2 comprises an electric motor, e.g. brushless motor, having an outlet shaft driving a screw-and-nut assembly so that rotation of the screw under drive from the motor causes the nut to perform a linear movement without rotating. The nut of the screw-and-nut assembly of each actuator 1, 2 enables the corresponding actuator to be attached to a movable element 200. Each actuator 1, 2 is dimensioned to be capable, on its own, of driving the movable element 200.

The first actuator 1 is associated with a first sensor 4 for measuring a force exerted by the first actuator 1 on the movable element 200 in order to move said movable element 200. In the same wav, the second actuator 2 is associated with a second sensor 5 for measuring a force exerted by the second actuator 2 on the movable element 200. In this example, the sensors 4 and 5 are axial force sensors incorporated. In the system 100

The system 100 also has a central control unit 3 connected to the first actuator 1 and to the second actuator 2 so that the central control unit 3 can send a respective position setpoint $Pos_1$, $Pos_2$ to each of the actuators.

The system 100 also has at least one position sensor for sensing the position of the movable element 200 in order to measure a real position. of the movable element 200. Preferably, the system 100 has two position sensors 6 and 7, both of which measure the real position of the movable, element 200 so as to provide the system 100 with greater redundancy. The measurement taken by a first one of the two position sensors 6 is thus substantially equal to the measurement taken by the second one of the two position sensors 7 under normal operating conditions of the two position sensors. If one of the two position sensors fails, the other position sensor can still act on its own to deliver information that is representative of the position of the movable element 200.

The central unit 3 is thus connected to the two position sensors 6 and 7 of the movable element. In this example, a first one of the two position sensors 6 is incorporated in the first actuator 1 and a second one of the two position sensors 7 is incorporated in the second actuator 2.

With reference to FIG. 1, in a first embodiment, under normal operating conditions of the two actuators 2, 2, the central control unit 3 sends a position setpoint $Pos_1$ solely to the first actuator 1, which is said to be a "master" actuator. In the event of the first actuator failing, the central control unit 3 then relies on the second actuator 2, which is said to be a "slave" actuator, in order to move the movable element 200. For this purpose, the central control twit 3 sends a position setpoint $Pos_2$ to the second actuator.

According to the invention, the system 100 includes control means that serve in operation to apply force control to both actuators 1 and 2 simultaneously in response to the position setpoint set to one of the actuators by the central control unit 3. In this example, the control means comprise first and second individual driver members 10, 20 connected respectively to the first and second actuators 1, 2. The two driver members 10, 20 are also connected to the central control unit 3, to the respective force sensors 4, 5, and to the respective position sensors 6, 7. The individual driver members 10, 20 are arranged in the system 100 in order to communicate with each other.

In operation, starting from an order to move the movable element 200 coming from one of the pilot control elements, the central control unit 3 generates a position setpoint $Pos_1$ for the first actuator 1.

The first individual driver member 10 then converts the position setpoint $Pos_1$ into a force setpoint and communicates with the second individual driver member 20 so that the first and second driver members 10, 20 act simultaneously to generate two individual force setpoints $Eff_1$, $Eff_2$ respectively for the first actuator 1 and for the second actuator 2.

The individual force setpoints $Eff_1$, $Eff_2$ are calculated so that the first and second actuators produce respective individual forces $F_1$, $F_2$ on the movable element 200, with the sum of the individual forces, i.e. $F_1+F_2$, corresponding to the total force that is to be delivered in order to reach the position setpoint $Pos_1$, and the forces $F_1$ and $F_2$ being substantially equal. Preferably, and for this purpose, throughout the movement of the movable element 200, measurements are taken of the position $Pos_m$ of said movable element simultaneously by both position sensors 6 and 7. Using the measured position $Pos_m$ and the position setpoint $Pos_1$, the two individual driver members 10, 20 determine the two individual force setpoints $Eff_1$, $Eff_2$ by taking account of the error between the position setpoint $Pos_1$ and the measured position $Pos_m$, while the two actuators 1, 2 are respectively exerting the forces $F_1$ and $F_2$ on the movable element 200. By regulating the individual forces $F_1$ and $F_2$, it is possible to obtain a sum of the individual forces, $F_1+F_2$, that matches the total force to be delivered in order to reach the position setpoint $Pos_1$, at least during normal operating conditions of the system 100.

Advantageously the control unit 3 also receives the measured position $Pos_m$ of the movable element 200. In the event of there being a difference between the setpoint position $Pos_1$ that the control unit 3 initially generated and the measured position, the control unit 3 may modify the position. setpoint $Pos_1$ in order to reduce said difference.

It should be observed that if either of the two position sensors 6 or 7 fails, then the other position sensor can continue to deliver information representative of the position of the movable element 200 to the control unit 3 and to one of the two individual driver members, which then communicates with the other individual driver member in order to share said information.

In this example, throughout the movement of the movable element 200, the first sensor 4 takes a measurement of the force $F_{1m}$ exerted by the first actuator 1 on the movable element 200. Likewise, throughout the movement of the movable element 200, the second sensor 5 takes a measurement of the force $F_{2m}$ exerted by the second actuator 2 on the movable element 200 Likewise from the measured forces $F_{1m}$, $F_{2m}$, the first and second individual driver members 10, 20 determine the individual force. setpoints $Eff_1$, $Eff_2$ that are appropriate for reducing the error between the position setpoint $Pos_1$ and the measured position $Pos_m$, when the two actuators 1, 2 are respectively exerting the forces $F_1$ and $F_2$ on the movable element 200.

Nevertheless, it can happen that one of the actuators is capable of developing only a limited force that prevents it from achieving the force setpoint that is required or it. This failure may be detected by the force sensor, for example. Under such circumstances, a failure signal $Def_1$, $Def_2$ is sent by the first actuator 1 or the second actuator 2 in question to the corresponding individual driver member 10, 20. The driver members 10, 20 then take account of this failure when generating the individual force setpoints $Eff_1$, $Eff_2$ enabling the total force that needs to be delivered to be approached as well as possible in order to reach the position setpoint $Pos_1$.

In a preferred embodiment, the failure signal may also be sent by the actuator in question to the central control unit 3 that takes account of this signal in order to rely on the non-failed actuator for the purpose of moving the movable element 200. If the first actuator 1 has failed, the central control unit 3 then relies on the second actuator 2, with the system 100 then operating in a manner that is identical to when the position setpoint is sent to the first actuator 1.

Advantageously, the control means arranged in this way in the system 100 make it possible to conserve programming of the central control unit 3 that is identical to the programming that exists in the prior art. Thus, the central control unit 3 generates a position setpoint for one of the actuators as in a prior art device. According to the invention, the control means communicate with each other in order to share out this position setpoint as force setpoints for the various actuators. The control means are thus programmed independently of the programming of the central control unit 3 that generates the position setpoint for a single one of the actuators.

Another advantage is that the two individual driver members 10, 20, monitor the states of both actuators 1, 2 as does the central control unit, thereby increasing the reliability of the system 100. This provides double monitoring both from an overall point of view in the central control unit 3 and from a local point of view in the control means.

FIG. 2 shows a second embodiment of the motor driven movement system of the invention. In this embodiment, the control means are directly incorporated in said central control unit 3. The central control unit 3 is then programmed to perform the functions of the individual driver members of the first embodiment.

In operation, starting from an order to move the movable element 200 coming from one of the pilot control elements, such as a stick, the central control unit 3 begins by calculating a position setpoint $Pos_1$ for the first actuator 1. Thereafter, on the basis of the position setpoint $Pos_1$, the control means simultaneously generate two individual force setpoints $Eff_1$, $Eff_2$ respectively for the first and second actuators 1 and 2. The individual force setpoints $Eff_1$, $Eff_2$ are calculated so that the first and second actuators produce respective. individual forces $F_1$, $F_2$ on the movable element 2001 with the sum of the individual forces, $F_1+F_2$, corresponding to a total force that is to be delivered in order to reach the position setpoints $Pos_1$, and with the forces $F_1$ and $F_2$ being substantially equal.

For this purpose, throughout the movement of the movable element 200, the position sensors 6, 7 take measurements of the position $Pos_m$ of said movable element. Using the measured position $Pos_m$ and the position setpoint $Pos_1$, the control means determine the two individual force setpoints $Eff_1$, $Eff_2$ by taking account of an error between. the position setpoint $Pos_1$ and the measured position $Pos_m$ while the two actuators 1, 2 are respectively exerting the forces $F_1$ and $F_2$ on the movable element 200.

Advantageously, the control unit 3 also receives the measured position $Pos_m$ of the movable, element 200. In the event of a difference between the position setpoint $Pos_1$ as initially generated by the control unit 3 and the measured position, the control unit 3 may modify the position setpoint $Pos_1$ in order to reduce said difference.

In this example, throughout the movement of the movable element 200, the first sensor 4 takes measurements of the force $F_{1m}$ exerted by the first actuator 1 on the movable element 200. Likewise, throughout the movement of the movable element 200, the second sensor 5 takes measurements of the force $F_{2m}$ exerted by the second actuator 2 on the movable element 200. Also on the basis of the measured forces $F_{1m}$, $F_{2m}$, the control means determine the individual force setpoints $Eff_1$, $Eff_2$ so as to reduce the error between the position setpoint $Pos_1$ and the measured position $Pos_m$ when the two actuators 1, 2 exert the forces $F_1$, $F_2$ respectively on the movable element 200.

Nevertheless, it may happen that one of the actuators can only develop only a limited force, thereby preventing it from reaching the force setpoint that is requested of it. Under such circumstances, a failure signal $Def_1$, $Def_2$ is sent by the first actuator 1 or the second actuator 2 in question to the central control unit 3, which then takes this signal into account in order to rely on the non-failed actuator for the purpose of moving the movable element 200. If the first actuator 1 has failed, then the central control unit 3 relies on the second actuator 2, with the system 100 then operating in a manner that is identical to when the position setpoint is sent to the first actuator 1.

Just like the first embodiment, the control means as incorporated in this way in the central control unit 100 enables to conserve programming for the central control unit 3 that is identical to the programming that already exists in the prior art. Said programming is merely added to in order to incorporate the functions of the individual driver members of the first embodiment. Thus, the central control unit 3 generates a position setpoint for one of the actuators as in a prior art device. According to the invention, the control means communicate with each other in order to share out this position setpoint into force setpoints for the various actuators. The control means are thus programmed independently of the programming of the central control unit 3 that serves to generate the position setpoint for a single one of the actuators.

Another advantage is that the control means monitor the states of both actuators 1, 2 as does the remainder of the central control unit, thereby increasing the reliability of the system 100. There is thus double monitoring both from an overall point of view in the central control unit 3 and from a local point of view in the control means;

Regardless of the embodiment of the invention, the central control unit 3 generates a position setpoint for one of the actuators and enables position to be servo-controlled on that setpoint. According to the invention, the control means incorporate this position servo-control. by superposing force servo-control thereon. There is thus servo-control from an overall point of view in the central control unit 3 and from a local point of view in the control means, thereby enabling very fine control to be achieved over the movable element.

Because of the control means, the actuator 1 that is considered to be the master actuator by the central control unit 3 exerts a force on the movable element 200 that is not equal to the force initially requested by the central control unit 3, but that is a force that is diminished by the force exerted by the second actuator 2 on the movable element 200. This serves to lengthen the lifetime of the actuator 1.

The invention is not limited to the above description and covers any variant coming within the ambit defined by the claims.

In particular, it is possible to envisage that the system 100 may have functions in addition to moving the movable element 200. For example, in the field of aviation, the system 100 of the invention may enable tests to be performed on the actuators while directly on board the aircraft during pre-flight testing. By way of example, a test may comprise two stages for testing both actuators 1, 2 in turn. In a first stage, the test thus comprises the steps of:

- converting a position setpoint for the movable element into a force setpoint;
- using the control means to generate the force setpoint for a "master" one of the actuators;
- using the control means, simultaneously with the preceding step, and on the basis of is position and opposing force profile, and of the position setpoint, to generate an opposing force setpoint for the "slave" second one of said actuators;
- measuring the position of the movable element; and
- comparing the position of the movable element with the position setpoint.

In a second stage, the test has exactly the same steps but with the slave and master roles of the two actuators being interchanged so that each actuator takes a turn at generating an opposing force.

The test thus makes it possible to evaluate each of the actuators in turn in order to observe how it is performing and detect any possible failure. By means of specific algorithms for making use of the results of the test, it is also possible to anticipate future failures of the actuators.

Figure 3:
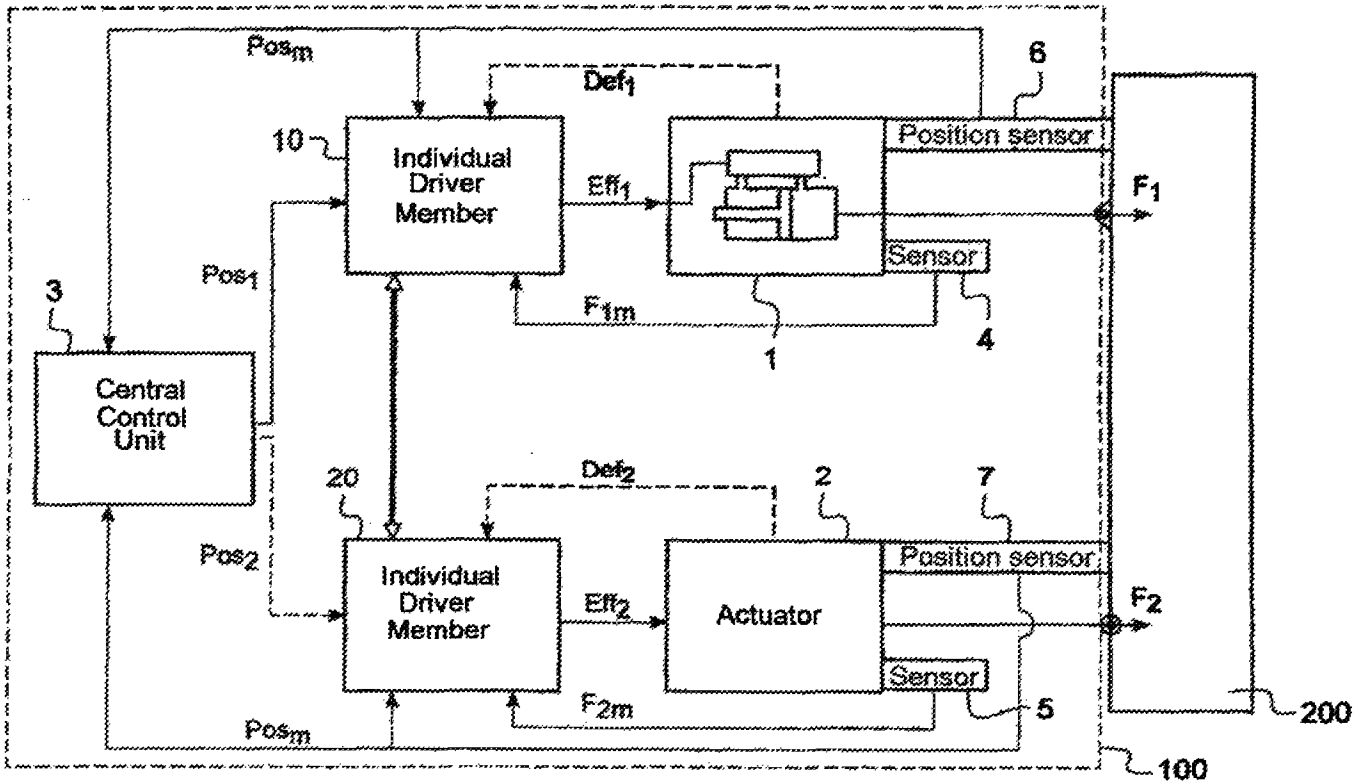
FIG. 3 is a diagrammatic view of a motor-driven system in a third embodiment for moving a movable element.

Although the actuators 1, 2 described above are linear actuators, the actuators could naturally be rotary actuators. In addition, although the actuators 1, 2, described above are electromechanical actuators, the actuators could be hydraulic actuators, as shown in FIG. 3.

Although the system 100 described herein has two actuators that are controlled simultaneously in terms of force, it is possible to envisage that the system 100 has a larger number of actuators, with the control means then controlling all of the actuators simultaneously in terms of force in response to the position setpoint addressed to one of the actuators.

In preferred manner, the individual driver members 10, 20 generate substantially equal individual force setpoints $Eff_1$, $Eff_2$ so that the first and second actuators produce individual forces $F_1$, $F_2$ on the movable element, with $F_1$ being substantially equal to $F_2$. It is possible to envisage calculating the individual. force setpoints so that the first and second actuators produce respective individual forces $F_1$, $F_2$ on the movable element 200 such that the sum of the individual, forces, $F_1+F_2$, corresponds to a total force to be delivered in order to reach the position setpoint $Pos_1$, without the force $F_1$ necessarily being substantially equal to the force $F_2$. Nevertheless, that would produce a motor-driven movement system 100 that is less well, optimized: for example, the lifetime of the actuator 1 will be lengthened to a smeller extent than when the actuator 1 exerts a force on the movable element that is substantially equal to the force $F_2$ exerted by the second actuator 2.

If the motor-driven movement system 100 has only one position sensor for sensing the position of the movable element 200, said position sensor should be connected simultaneously to the central control unit 3 and to both of the individual driver members 10, 20 in the first embodiment, and should be connected to the central control unit 3 in the second embodiment. Although each individual driver member 10, 20 in the first embodiment is connected to only one of the position sensors, each of the individual driver members 10, 20 could be connected to both of the position sensors 6, 7.

The invention claimed is:

1. A motor-driven movement system for moving a movable element, the system comprising at least two actuators, each provided with means connecting it to the movable element and each dimensioned to be capable, on its own, of driving the movable element, and a central control unit being connected to the two actuators in order to be capable of sending a position setpoint to one or other of the actuators, wherein the system further comprises control means for simultaneously controlling the two actuators in terms of force in response to a unique position setpoint sent to one of the actuators, the control means being configured to simultaneously generate two individual force setpoints respectively for the first and second actuators on the basis of the position setpoint sent to one of the actuators such that, at least during normal operating conditions of the system, each actuator produces an individual force and the sum of the individual forces corresponds to a total force to be delivered in order to reach the position setpoint, the control means being then configurated to incorporate a position servo-control based on the position setpoint and to superpose force servo-control on said position servo-control, wherein the force is shared between the at least two actuators so that neither of the actuators is stressed excessively more than the other.

2. The system according to claim 1, wherein the control means are incorporated in the central control unit.

3. The system according to claim 1, wherein the control means are independent of the central control unit.

4. The system according to claim 3, wherein the control means comprise two individual driver members, each associated with a respective one of the actuators, the two individual driver members being arranged to communicate with each other.

5. The system according to claim 1, wherein the actuators are electromechanical actuators.

6. The system according to claim 1, wherein the actuators are hydraulic actuators.

7. A method of simultaneously driving the position of at least one of two actuators of a motor-driven movement system, each actuator being dimensioned to be capable, on its own, of driving a common movable element, the method comprising the step of, at least during normal operating conditions of the system, responding to a unique position setpoint sent to a "master" one of the actuators by implementing a servo-control loop having as its input the position setpoint and generating simultaneously for the master actuator and for the "slave" second actuator two individual force setpoints, such that each actuator produces an individual force and the sum of the individual forces corresponds to a total force to be delivered in order to reach the position setpoint, so that the servo-control loop comprises incorporating a position servo-control based on the position setpoint and superposing force servo-control said position servo-control, wherein the force is shared between the at least two actuators so that neither of the actuators is stressed excessively more than the other.

8. The method according to claim 7, wherein the servo-control loop generates simultaneously two individual force setpoints respectively for the master actuator and for the slave actuator, so that the two individual forces produced by the two actuators are also substantially equal.

* * * * *